US007878346B1

(12) United States Patent
Watts et al.

(10) Patent No.: US 7,878,346 B1
(45) Date of Patent: Feb. 1, 2011

(54) ADAPTABLE BOOM EXTENSION FOR A MOBILE CRANE HAVING A TELESCOPING BOOM

(75) Inventors: Samuel Casey Watts, Lexington, KY (US); Daniel L. Harrington, Lexington, KY (US); Dennis M. Schnieders, Lexington, KY (US)

(73) Assignee: Link-Belt Construction Equipment Co., L.P., LLLP, Lexington, KY (US)

( * ) Notice: Subject to any disclaimer, the term of this patent is extended or adjusted under 35 U.S.C. 154(b) by 156 days.

(21) Appl. No.: 12/197,529

(22) Filed: Aug. 25, 2008

(51) Int. Cl.
*B66C 23/04* (2006.01)

(52) U.S. Cl. ..... 212/168; 212/270; 212/300

(58) Field of Classification Search ..... 212/168, 212/270, 300
See application file for complete search history.

(56) References Cited

U.S. PATENT DOCUMENTS

| | | | |
|---|---|---|---|
| 3,430,778 | A | 3/1969 | Brown |
| 3,698,569 | A | 10/1972 | Lamer et al. |
| 3,732,988 | A | 5/1973 | Lamer |
| 3,785,505 | A | 1/1974 | Keller, Jr. |
| 3,830,376 | A | 8/1974 | Fritsch |
| 3,831,771 | A | 8/1974 | Wiencek |
| 3,944,082 | A | 3/1976 | Fritsch |
| 3,945,333 | A | 3/1976 | Fritsch et al. |
| 3,968,884 | A | 7/1976 | Johnson et al. |
| 4,091,936 | A | 5/1978 | Wuerflein et al. |
| 4,141,455 | A | 2/1979 | Henderson et al. |
| 4,383,616 | A | 5/1983 | Sterner et al. |
| 4,431,109 | A | 2/1984 | Behrendt et al. |
| 4,483,447 | A | 11/1984 | Bernabe, Jr. |
| 4,484,686 | A | 11/1984 | Mentzer |
| 4,491,229 | A | 1/1985 | Behrendt et al. |
| 4,621,742 | A | 11/1986 | Rathi |
| 4,653,655 | A | 3/1987 | Rathi et al. |
| 4,828,124 | A | 5/1989 | Iga |
| 4,953,724 | A | 9/1990 | Koizumi |
| 5,111,945 | A | 5/1992 | Hull et al. |
| 5,115,925 | A | 5/1992 | Koizumi |
| 5,143,233 | A | 9/1992 | Koizumi |
| 5,193,698 | A | 3/1993 | Koizumi |
| 5,673,805 | A | 10/1997 | Chaffin |
| 6,036,035 | A * | 3/2000 | Asano et al. ..... 212/300 |

(Continued)

FOREIGN PATENT DOCUMENTS

JP 3-216499 A * 9/1991

(Continued)

*Primary Examiner*—Thomas J Brahan
(74) *Attorney, Agent, or Firm*—King & Schickli, PLLC

(57) ABSTRACT

A mobile crane includes a boom extension assembly carried alongside a telescoping boom assembly in a stowed position. The boom extension assembly includes a fly section with a first portion adapted for being connected to the head end of the boom assembly in an operative position while a second portion of the fly section adapted for being connected to the first portion remains in the stowed position. The first portion of the fly section may: (1) be shorter in length than the corresponding second portion of the fly section; (2) include sheaves for supporting a hoist line; (3) include a tapered end; or (4) be used in combination with two additional sections of the boom extension assembly. A related method includes connecting a first, shorter portion of a fly section to a head end of a telescoping boom assembly while a second portion remains in a stowed position.

24 Claims, 14 Drawing Sheets

U.S. PATENT DOCUMENTS

| | | | | |
|---|---|---|---|---|
| 6,131,750 | A | 10/2000 | Harrington | |
| 6,186,347 | B1 | 2/2001 | Reifenscheid et al. | |
| 6,276,541 | B1 | 8/2001 | Gevaudant | |
| 6,336,565 | B1 | 1/2002 | Merkel et al. | |
| 7,131,548 | B2 | 11/2006 | Hinrichs et al. | |
| 7,156,245 | B2 | 1/2007 | Lissandre | |
| 7,258,242 | B2 | 8/2007 | Irsch et al. | |
| 7,337,912 | B1 * | 3/2008 | Hull et al. | 212/300 |

FOREIGN PATENT DOCUMENTS

| | | | |
|---|---|---|---|
| JP | 5-139693 A | * | 6/1993 |
| JP | 8-40691 A | * | 2/1996 |

* cited by examiner

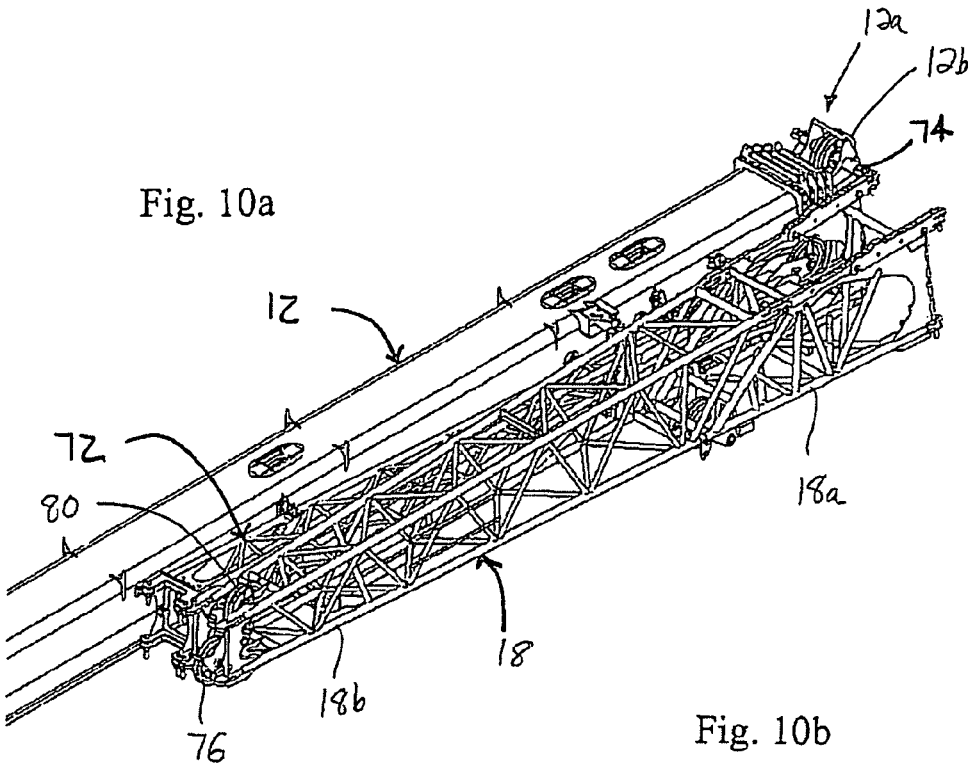
Fig. 10a
Fig. 10b
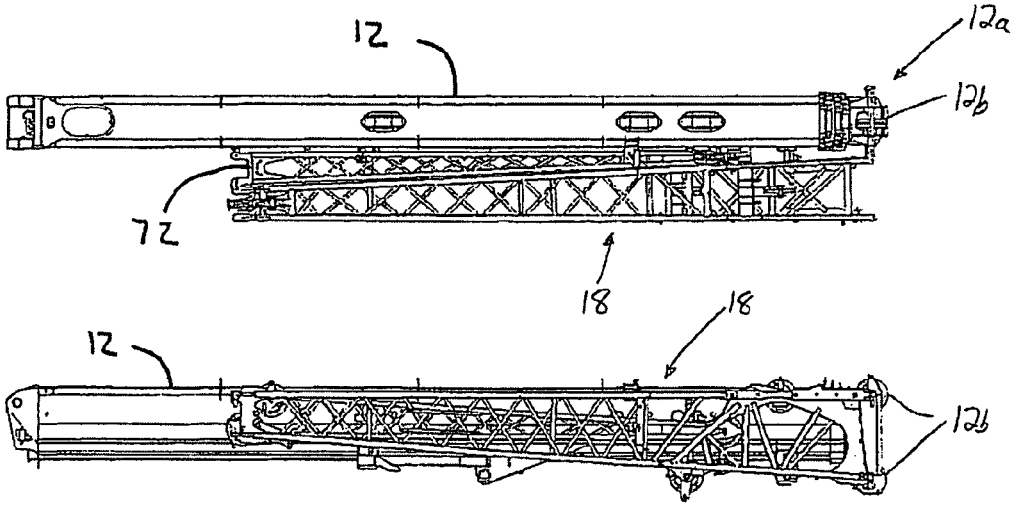
Fig. 10c

Fig. 12a
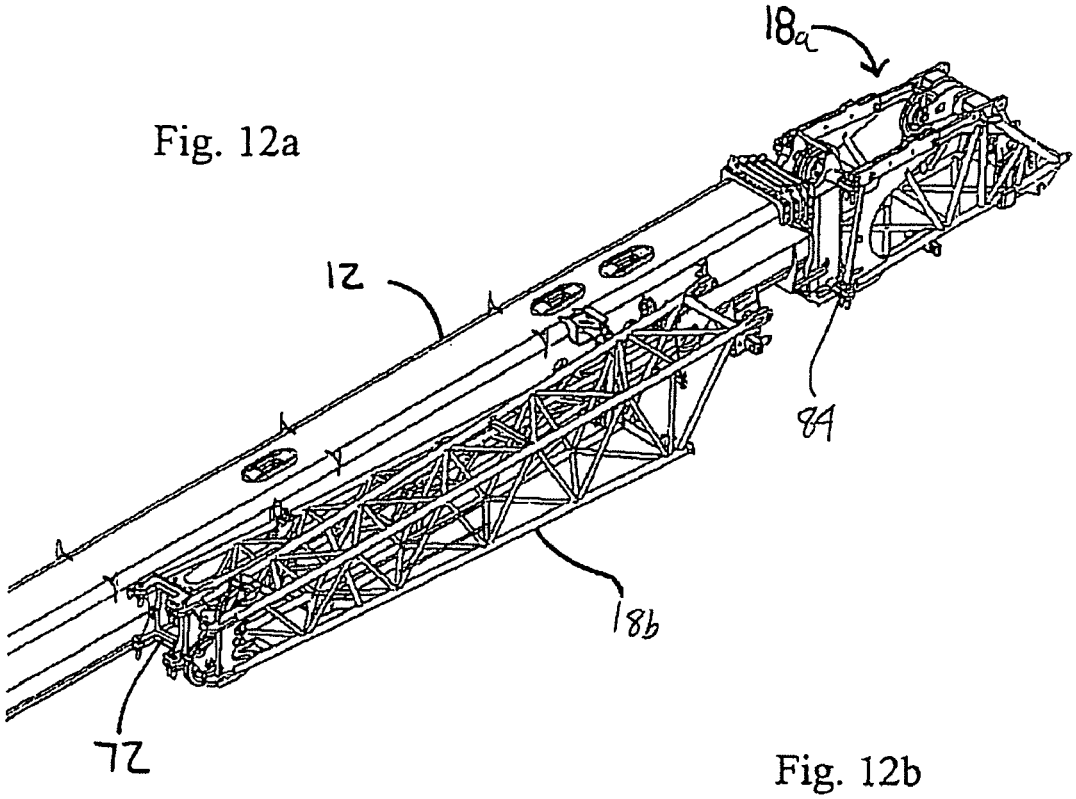
Fig. 12b
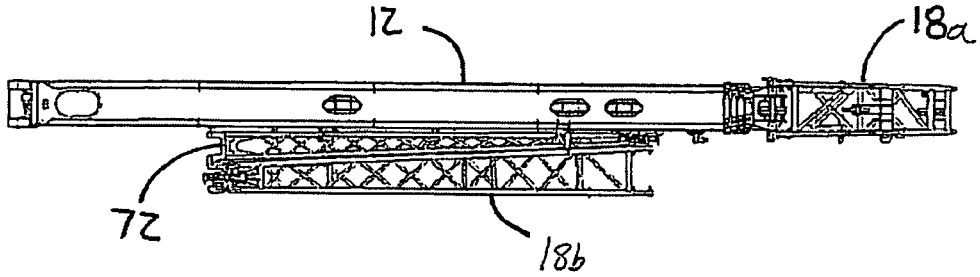
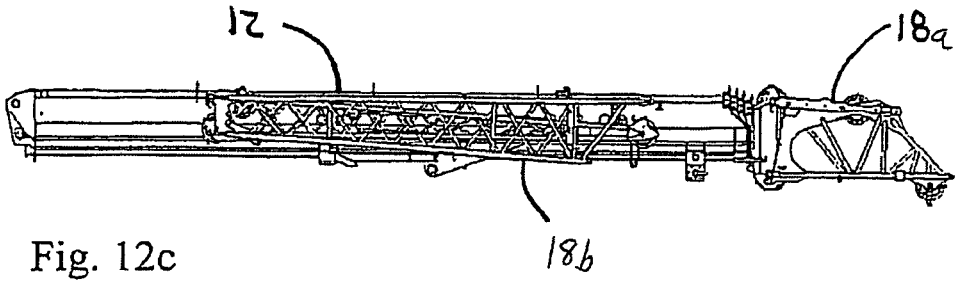
Fig. 12c

ADAPTABLE BOOM EXTENSION FOR A MOBILE CRANE HAVING A TELESCOPING BOOM

TECHNICAL FIELD

The present invention relates generally to cranes and, more particularly to an adaptable boom extension assembly for extending a telescoping boom assembly in a mobile crane.

BACKGROUND OF THE INVENTION

Various types of boom assemblies for use in cranes or other lifting devices are known in the art. Generally, conventional mobile cranes have an extendable boom assembly including a plurality of telescoping boom sections. Oftentimes, a folded boom extension is stowed alongside the boom assembly. This extension is capable of pivoting into an operative position at the head end of the boom assembly to extend the effective length of the boom assembly, or to change the angular relationship between the head end of the boom assembly and the corresponding hoist line used to lift an object.

An example of this approach is shown in U.S. Pat. No. 4,491,229. In this approach, the boom extension includes a fly section that may be stowed alongside the boom assembly and pivoted to an operative position so as to extend the boom assembly. In the stowed position, an associated jib or "tip" section underlies the base or "fly" section, and in use swings outwardly with the fly section to an aligned position with the boom assembly. If desired, the fly section may be mounted to the head end of the boom assembly while the jib section remains in the stowed position.

While this arrangement accomplishes the goal of selectively increasing the effective length of the boom assembly, it is not without limitation. As one example, the fly and jib sections are quite similar in length, which seriously limits the versatility of this arrangement. Specifically, it is not possible to achieve a shorter lift point using of the fly section only or the combination of the fly section and jib section. In addition, when the fly section either alone or in combination with the jib section is connected to the main boom assembly, the main boom capacity is diminished. Finally, the fly section does not enable the simultaneous use of multiple hoist lines.

Accordingly, a need is identified for a boom extension arrangement that addresses and overcomes the foregoing limitations. Specifically, it is desirable to provide a relatively short "fly" extension stored on the side of the telescopic boom and moved into use without the need for erecting the full extension section, thereby providing a shorter lift point and maximizing the lifting capacity. Compared to past proposals for bringing a separate adaptor section on site, the resulting system would be somewhat less complicated in design, less expensive to manufacture, and easier to install and use.

SUMMARY OF THE INVENTION

In accordance with one aspect of the disclosure, a mobile crane for intended use in lifting an object using one or more hoist lines is provided. The crane comprises a boom assembly including at least two telescoping boom sections and a head end. A boom extension assembly is carried alongside the boom assembly in a stowed position. The boom extension assembly comprises a fly section including a first portion adapted for being connected to the head end of the boom assembly in an operative position while a second portion of the fly section adapted for being connected to the first portion remains in the stowed position. The first portion of the fly section is shorter in length than the second portion of the fly section.

In one embodiment, the boom extension assembly further includes a jib section for connection to a first end of the second portion of the fly section. In such instance, the first portion of the fly section is shorter in length than the jib section.

Preferably, the first portion of the fly section includes at least one sheave for receiving a first hoist line. Most preferably, the head end of the boom assembly includes a first sheave for receiving a first hoist line and the first portion of the fly section includes a second sheave for receiving a second hoist line. The two hoist lines maintained in relatively close proximity may thus be used independently to lift or turn an object.

Also preferable is the provision of the first portion of the fly section with a first end having upper and lower members of different lengths. Likewise preferable is to provide the second portion of the fly section with a second end matching the first end of the first portion of the fly section.

The portions of the first boom section may comprise a latticework body. The portions may further include lugs with horizontally aligned apertures for receiving one or more pins for interconnecting them to complete the fly section.

In another aspect, the disclosure pertains to a mobile crane for intended use in lifting an object using first and second hoist lines. The crane includes a boom assembly including at least two telescoping boom sections and a head end including a first sheave for receiving the first hoist line. A boom extension assembly carried alongside of the boom assembly comprises a fly section having a first portion adapted for being connected to the head end of the boom assembly in an active position while a second portion adapted for being connected to the first portion of the fly section remains in a stowed position. The first portion of the fly section includes at least one second sheave for receiving the second hoist line.

In another aspect of the disclosure, a mobile crane for intended use in lifting objects includes a boom assembly with at least two telescoping boom sections and a head end and a boom extension assembly carried on the side of the boom assembly. The boom extension assembly comprises a fly section having a first portion adapted for being connected to the head end of the boom assembly in an active position while a second portion adapted for being connected to the first portion of the fly section remains in a stowed position. The first portion of the fly section includes a first end having upper and lower members of different lengths, and the second portion of the fly section includes a second end matching the first end of the first portion of the fly section.

Another, related aspect of the disclosure is an improvement in a mobile crane including a boom extension assembly carried alongside a telescoping boom assembly in a stowed position and movable to an active position for extending the reach of the telescoping boom assembly. Specifically, the improvement comprises providing the boom extension assembly with at least three releasably attached sections.

A further aspect of the disclosure is a method of selectively extending a telescoping boom assembly of a mobile crane. The method comprises providing a boom extension assembly alongside the telescoping boom assembly in a stowed position. The boom extension assembly comprises a fly section including a first portion shorter in length than a second portion. The method further comprises connecting the first portion of the fly section to a head end of the telescoping boom assembly while the second portion of the fly section remains in the stowed position.

In one embodiment, the method further includes the steps of providing the connected first portion of the fly section with a first hoist line and providing the head end of the boom assembly with a second hoist line. Still further, the method may include the steps of disconnecting the first portion of the fly section from the head end of the telescoping boom assembly, and connecting the first portion of the fly section to the second portion of the fly section. The method may also involve reconnecting the fly section including the first and second portions to the head end of the telescoping boom assembly, as well as optionally connecting a jib section to the fly section.

Still other objects of the present invention will become apparent to those skilled in the art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects, all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles of the disclosed embodiments of the invention.

In the drawings:

FIGS. 10*a*, 10*b*, and 10*c* are perspective, top, and side views of the main boom assembly with the boom extension assembly in a stowed position;

FIGS. 12*a*, 12*b*, and 12*c* are perspective, top, and side views of the main boom assembly with the short fly portion in the operative position and the remaining portions of the boom extension assembly stored alongside the main boom assembly.

DETAILED DESCRIPTION OF THE PREFERRED EMBODIMENT

Figure 1:
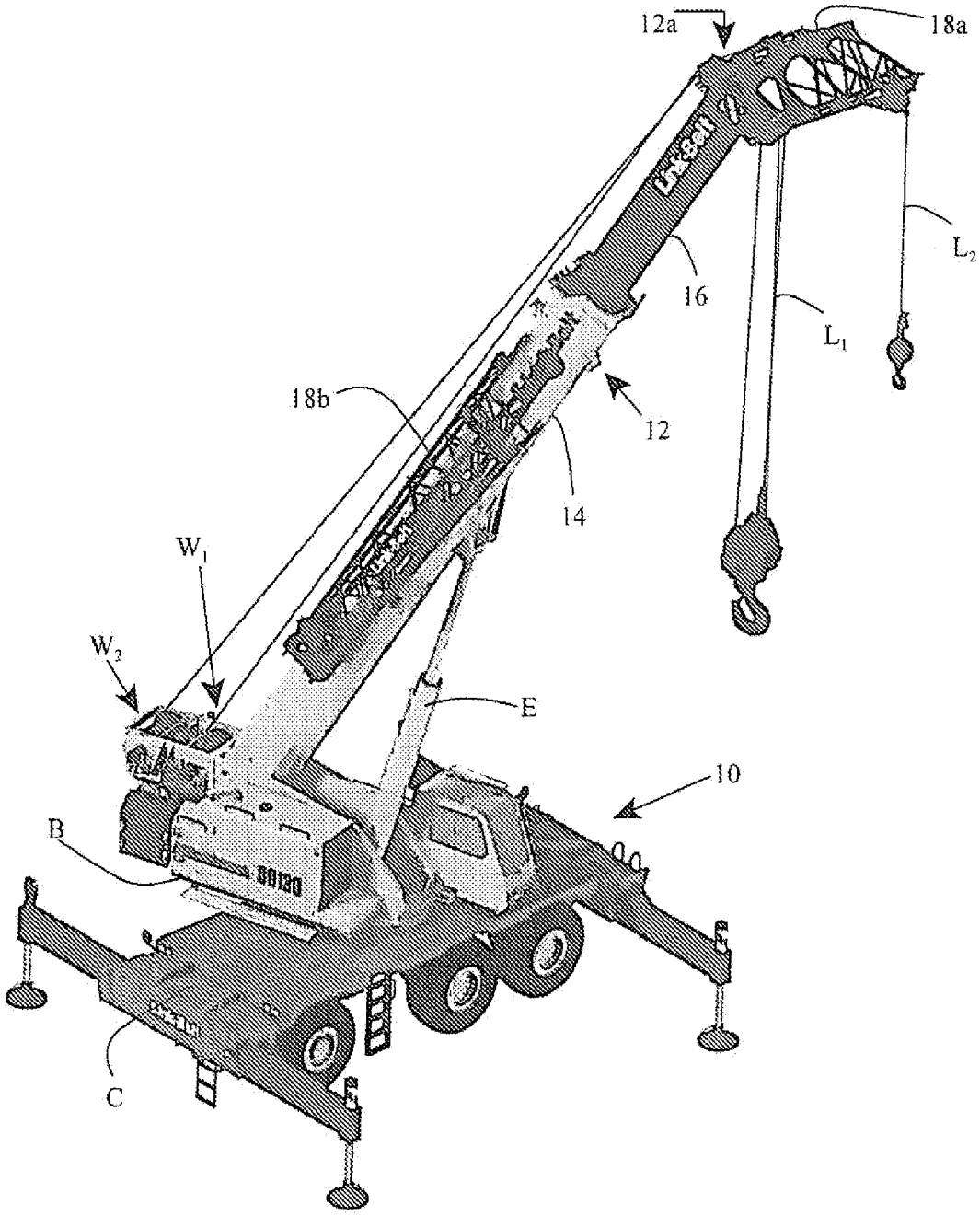
FIG. 1 is a perspective view of a mobile crane incorporating an adaptable boom extension forming one aspect of the disclosure.

Reference is now made to FIG. 1, which provides an overall perspective view of a mobile crane 10 for which the inventions described herein may have utility. In the embodiment illustrated in FIG. 1, this crane 10 includes a "main" boom assembly 12 having at least two generally tubular boom sections 14, 16. The first or outer main boom section 14 is pivotally mounted on a bodily rotatable base B supported by a wheeled chassis C, while the second main boom section 16 is telescopically received within the first main boom section 14. It should be appreciated that additional boom sections may be telescopically received within the second main boom section 14 and so on. An internal hydraulic cylinder (not shown) is provided to move the telescoping boom sections 14, 16 relative to each other in a manner known in the art, and an external cylinder E pivots the entire boom assembly 12 in a vertical direction.

In accordance with one aspect of the disclosure, a first boom extension, or "fly," section 18 is provided for use in selectively extending the length of the telescoping boom assembly 12. In the illustrated embodiment, this first boom extension section 18 tapers from a wider extent at one end to a narrower extent at the other, and is "adaptable" to different configurations in use (including one in which a shorter lift point than heretofore possible can be easily and efficiently achieved). To accomplish this, the "fly" or first boom section 18 is divided into at least a first portion 18*a* and a second portion 18*b* removably connected to the first portion in a manner outlined further in the following description. FIG. 1 shows the first portion 18*a* of the boom extension assembly 18 in its active or operating position connected to the head end 12*a* of the boom assembly 12, while the second portion 18*b* remains in a stowed position alongside the boom assembly 12.

Figure 2:
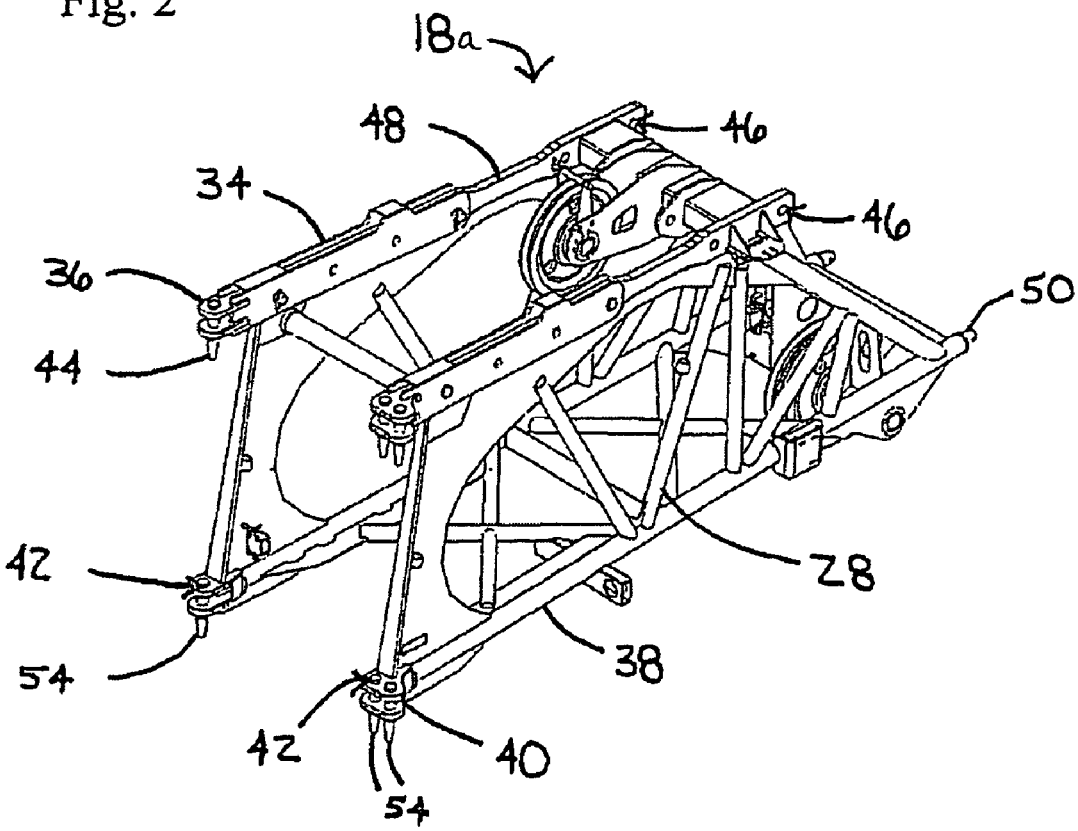
FIG. 2 is a perspective view of a "short fly" portion of a first section of the boom extension assembly.
Figure 3:
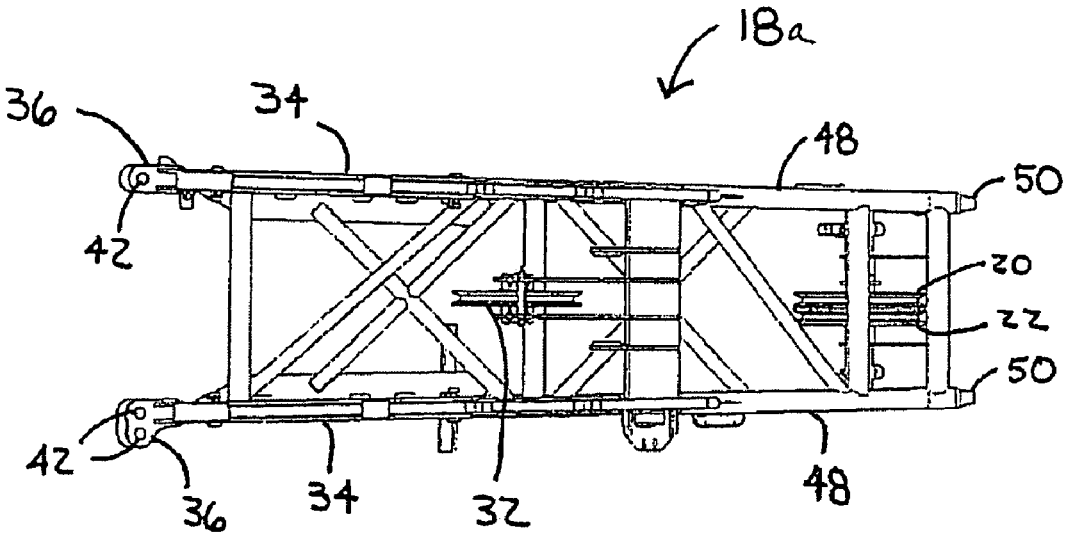
FIG. 3 is a top view of the short fly portion of the first boom extension section.
Figure 4:
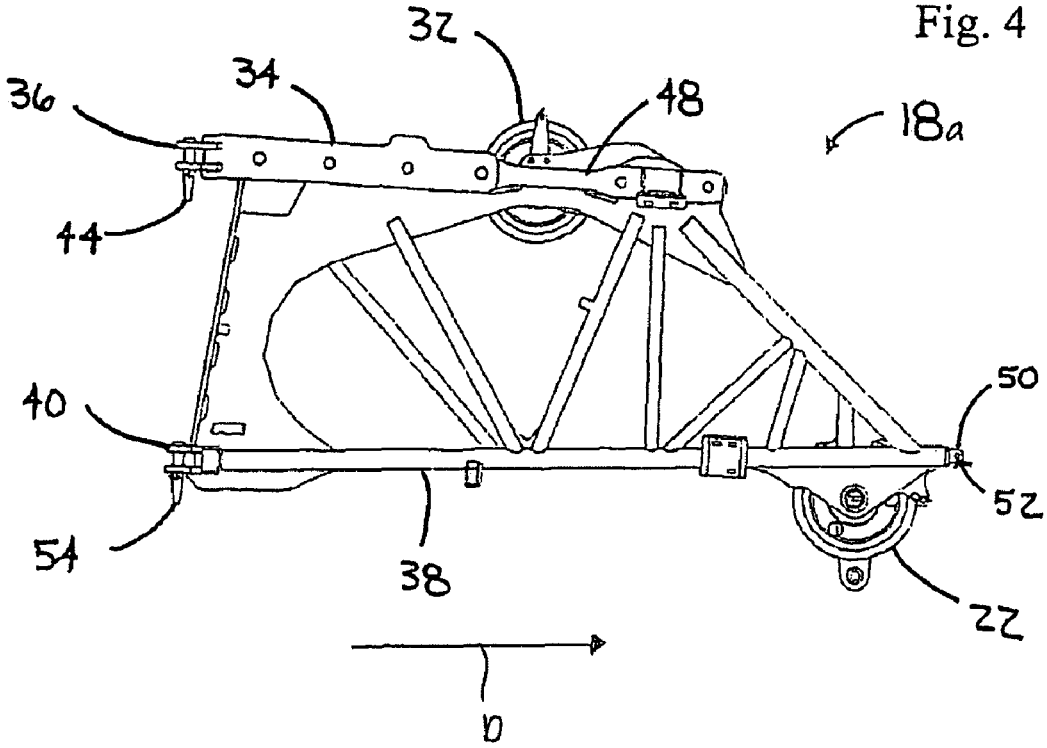
FIG. 4 is a side view of the short fly portion of the first boom extension section.

Before discussing the possible uses of the adaptable boom extension section 18, the details of one embodiment of the first portion 18*a* are best shown in FIGS. 2-4. First referring to FIG. 2, the first portion 18*a* preferably comprises a latticework body 28 formed of a plurality of interconnected (e.g., welded) members or lugs. Specifically, a pair of upper bars 48 extend in a generally parallel fashion and attach to a pair of struts 34 at one end. The pair of struts 34 terminate in a pair of top adapter lugs 36, which have vertically aligned holes 42. In use, upper pins 44 are inserted generally vertically through the aligned, registered holes to form a secure connection with the head end of the boom assembly 12. At the other end of the first portion 18*a* of the boom extension section 18, the bars 48 include apertures 46 for receiving pins that may connect it with the second portion 18*b*, either in the stowed or active position.

The first portion 18*a* of the boom extension section 18 also includes a pair of generally parallel cylindrical rods 38 arranged below and generally aligned with the bars 48. These rods 38 terminate in bottom adapter lugs 40. Similar to lugs 36, these adapter lugs 40 have vertically aligned holes 42 for receiving lower pins 54 to form a connection with the head end 12*a* of the boom assembly 12. Tapered "dead" ends 50 of the rods 38 include openings 52 for receiving transverse fasteners, such as pins, to form a secure connection with the second portion 18*b* of the boom extension assembly 18.

This first portion 18*a* of the boom extension section 18 further includes at least one, and most preferably a plurality of sheaves or pulleys, which may be used to guide one or more hoist lines used for lifting one or more objects during operation of the crane 10. In the particular embodiment illustrated, a pair of sheaves 20, 22 provided at one end of the first portion 18*a* of the boom extension section 18, while an intermediate deflector sheave 32 is located approximately in the upper middle of this first portion 18*a*. As will be understood upon reviewing the description that follows, this arrangement potentially allows for multiple hoist lines to be used in connection with the first portion 18*a* of the boom extension section 18.

Referring specifically to FIG. 4, it should also be appreciated that one end of the first portion 18*a* is generally tapered or sloping in a first or longitudinal direction D. Specifically, the lower rods 38 generally extend a greater distance in the longitudinal direction D than the combined length of the struts 34 and bars 48. In this preferred embodiment, this provides the "nose" end of the first portion 18*a* with a generally triangular profile. As will be understood upon reviewing the description that follows, this shape helps this first portion 18*a* of the boom extension section 18 reach into tighter spaces than if the end was generally square or otherwise not tapered in this manner.

Figure 5A:
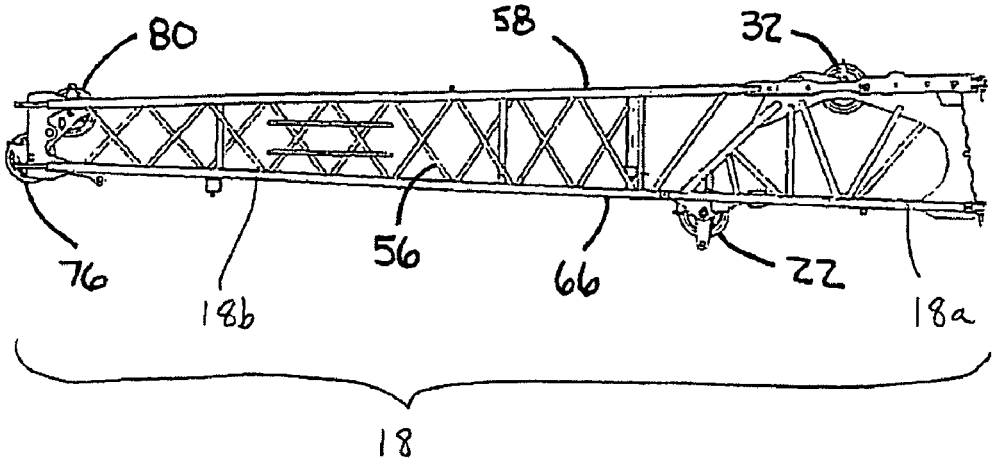
FIG. 5*a* is a side view of the short fly portion of the first boom extension section mechanically connected to a second portion of the first extension section.
Figure 5B:
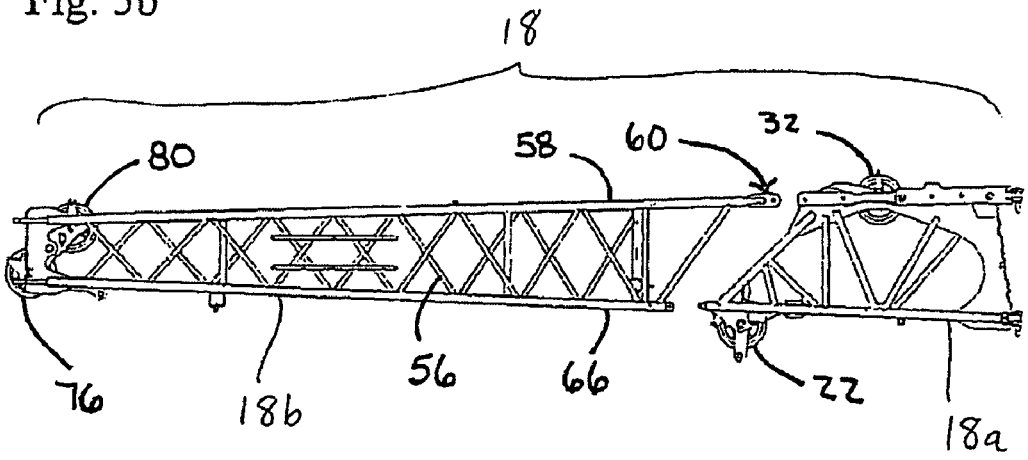
FIG. 5*b* is a side view of the short fly portion disconnected from the second portion of the first boom extension section.
Figure 6A:
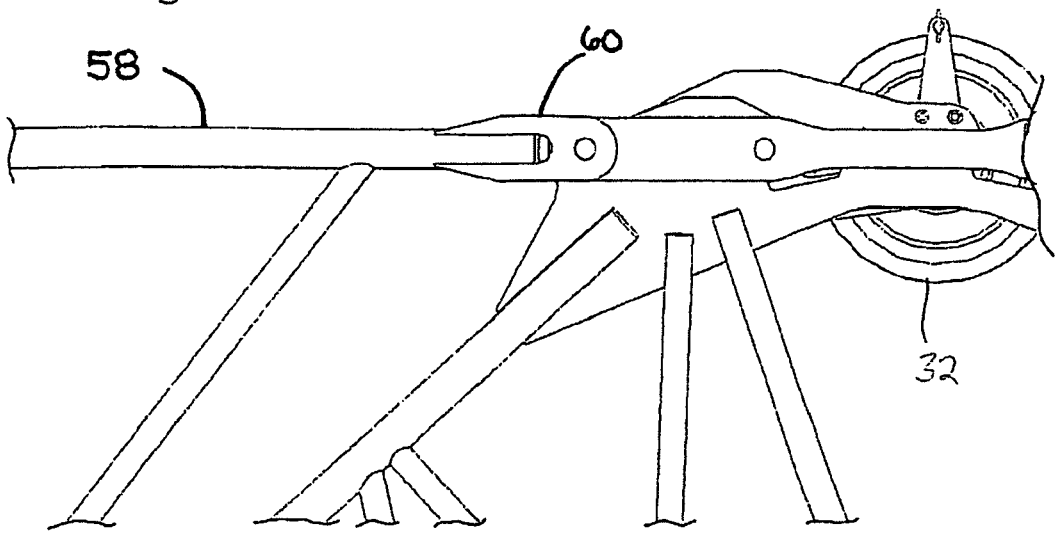
FIG. 6*a* is a partial side view of the upper half of the short fly portion mechanically connected to a second portion of the boom extension section.
Figure 6B:
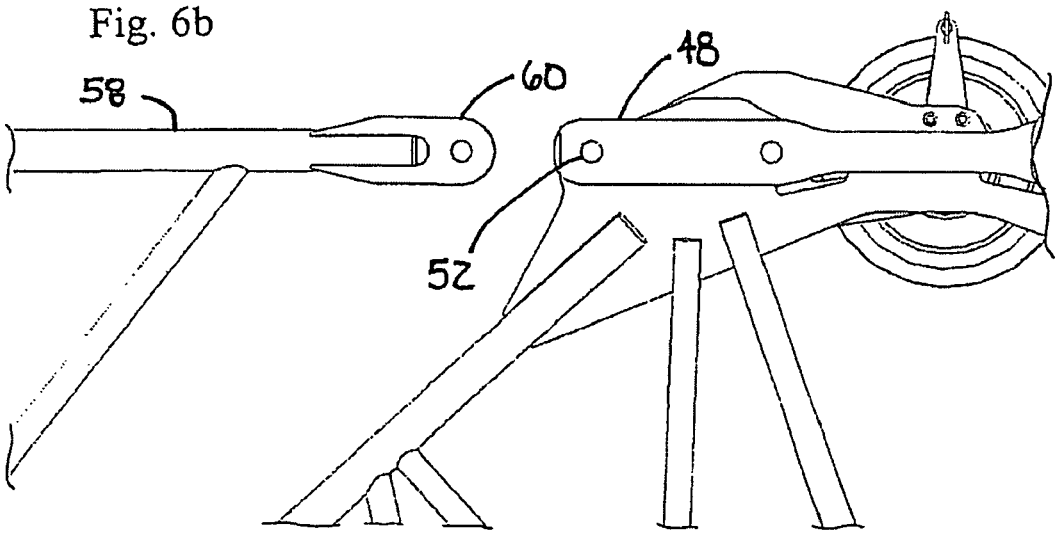
FIG. 6*b* is a partial side view of the upper half of the short fly extension section of FIG. 6*a;*
Figure 7A:
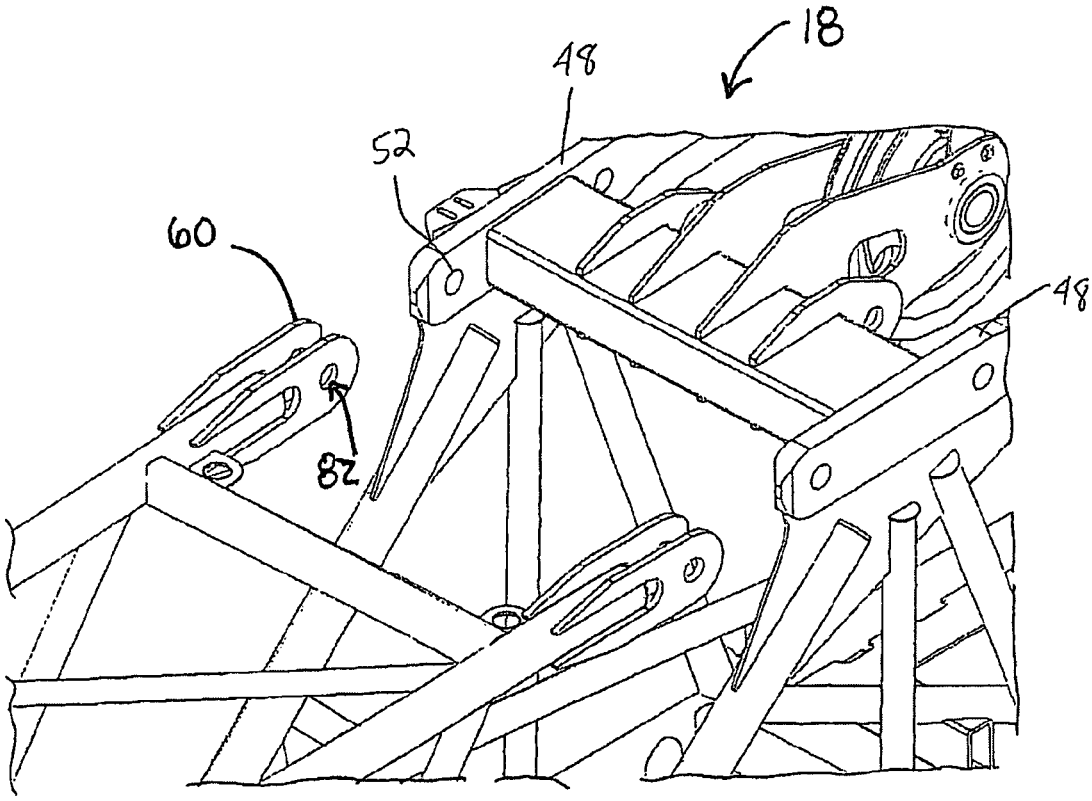
FIG. 7*a* is a partial perspective view of the upper half of the short fly portion disconnected from the second portion of the first boom extension section.
Figure 7B:
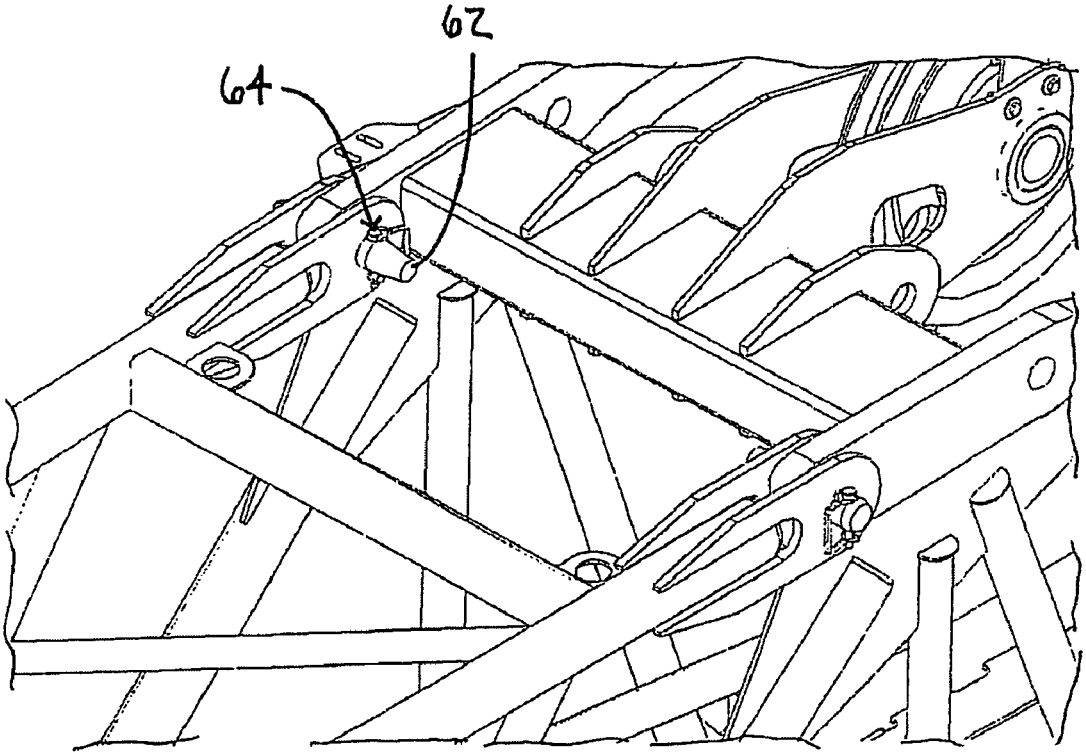
FIG. 7*b* is a partial perspective view of the upper half of the short fly portion of the extension section mechanically connected to the second portion of the boom extension section.
Figure 8A:
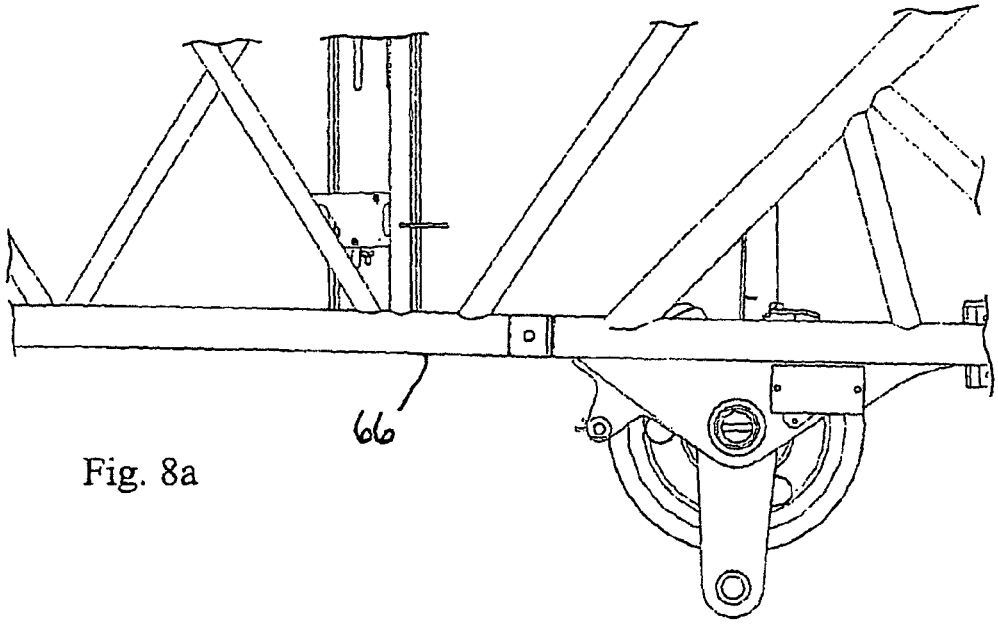
FIG. 8*a* is a partial side view of the bottom half of the short fly portion mechanically connected to the second portion of the first boom extension section.
Figure 8B:
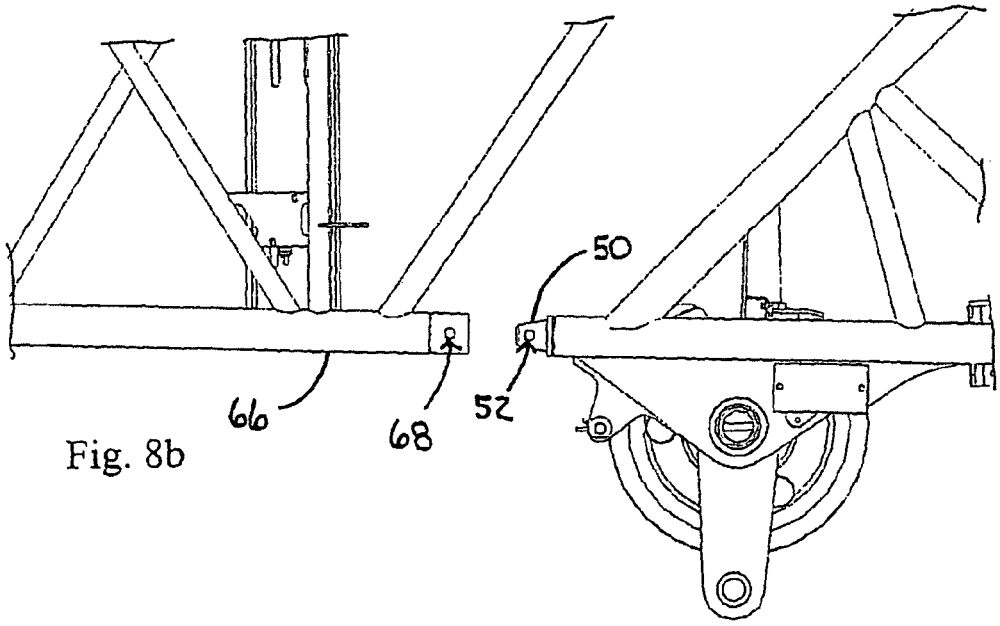
FIG. 8*b* is a partial side view of the bottom half of the short fly portion of the first boom extension section disconnected from the second portion.
Figure 9A:
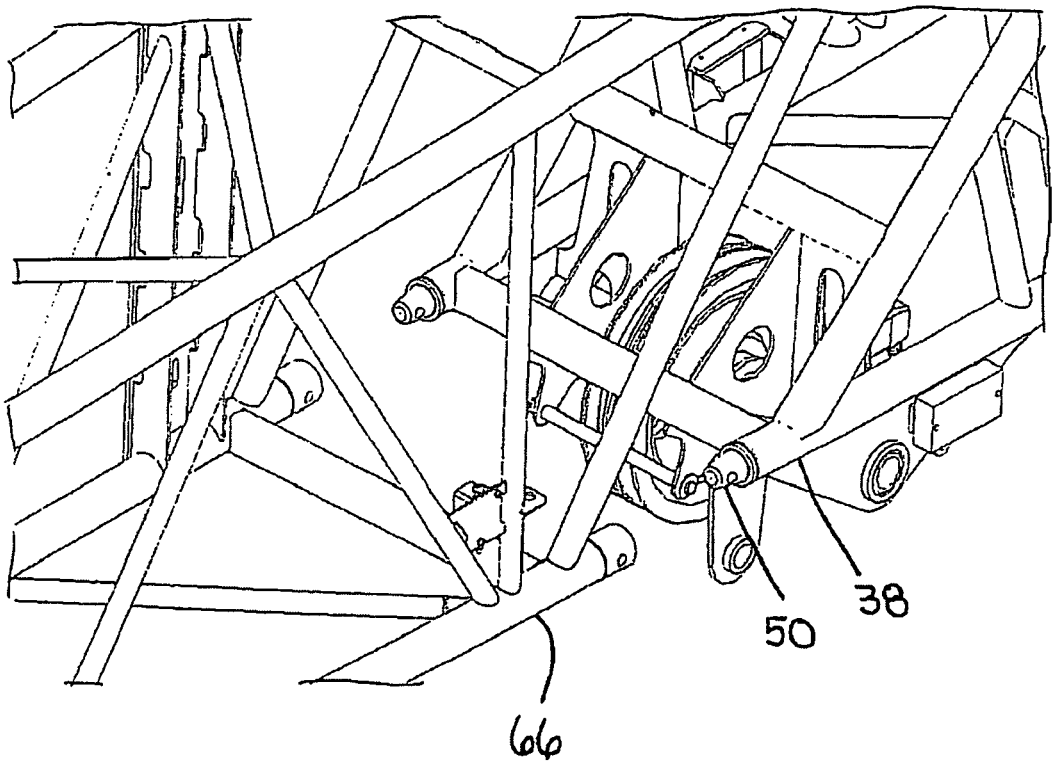
FIG. 9*a* is a partial perspective view of the bottom half of the short fly portion of the first boom extension section disconnected from the second portion.
Figure 9B:
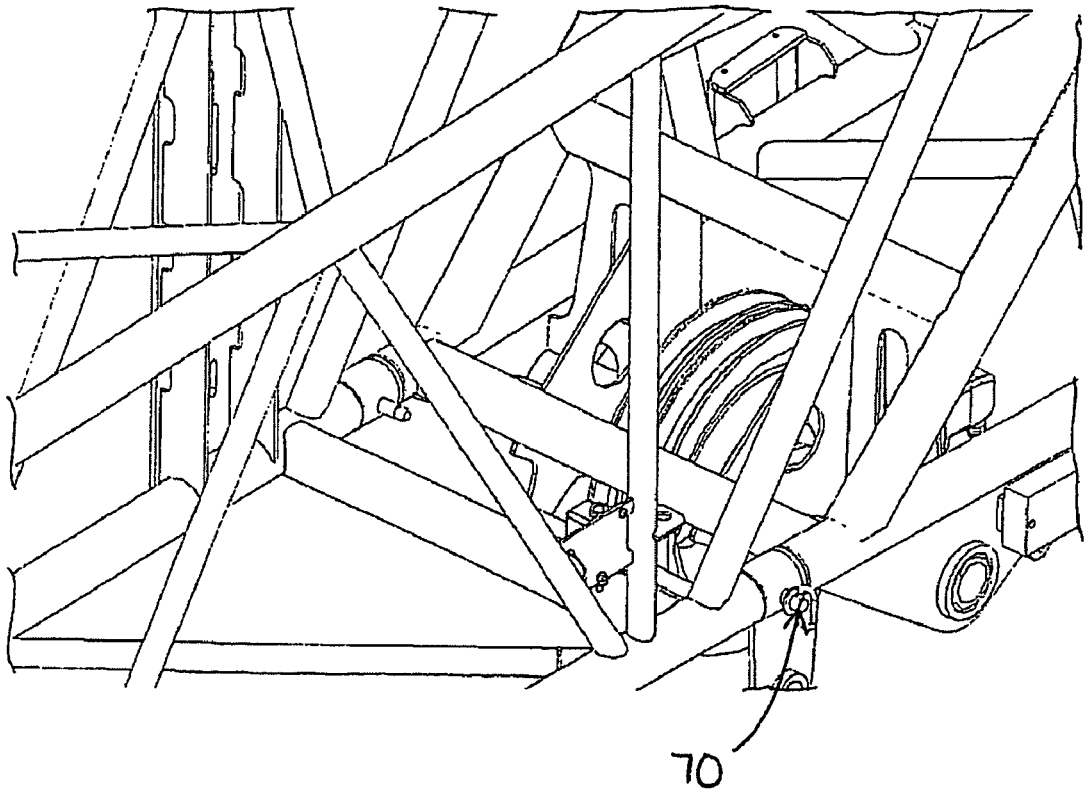
FIG. 9*b* is a partial perspective view of the bottom half of the short fly portion of the first boom extension section mechanically connected to the second portion.

Turning to FIGS. 5-7, the first and second portions 18*a*, 18*b* of the boom extension section 18 are shown mounted together, but positioned apart from the main boom assembly 12 for purposes of clarity. As can be appreciated from FIGS. 5*a* and 5*b*, the second portion 18*b* of the boom extension section 18 comprises a rigid, latticework body 56 including two upper longitudinally extending members 58. As best understood from FIGS. 6*a*-6*b* and 7*a*-7*b*, these members 58 include clevis-type connectors 60 on a first end for connecting to the first portion 18*a* of the boom extension section 18. Associated horizontally aligned apertures 52, 82, in use, mate with the bars 48 of the first portion 18*a* of the boom extension section 18. Once mated, clevis pins 62 are inserted through the horizontally aligned apertures 52, 82 of the connectors 60 and the apertures 46 in the bars 48 to secure the first and second portions 18*a*, 18*b* together. Pins 64 may be used to retain the clevis pins 62 in place, as it specifically shown in FIG. 7*b*.

Referring now to FIGS. 8*a*-8*b* and 9*a*-9*b*, the first and second portions 18*a*, 18*b* also connect in a second location to further secure the connection. Specifically, the second portion 18*b* includes two lower longitudinally extending members 66 that have holes 68 at one end for aligning with the openings 52 of the "dead end" projections 50 of the first portion 18*a*. The lower members 66 receive these projections 50 and, once the holes 68 and openings 52 are properly aligned, pins 70 are inserted to complete the secure connection. In the stored position, the first portion 18*a* and the second portion 18*b* are thus mechanically connected at the corresponding ends, essentially in a "head-to-tail" relationship.

Similar to the first portion 18*a* of the boom extension section 18, the second portion 18*b* preferably also includes sheaves or pulleys for accommodating one or more hoist lines. Specifically, at least one hoist sheave 76 may be used to guide ropes or cables attached to hooks during operation of the crane 10. Further, a deflector sheave 80 may also be provided to deflect and guide the hoist line to these relatively remote hoist sheave 76.

As should be appreciated, the corresponding end of the second portion 18*b* of the boom extension section 18 generally matches with the tapered end of the first portion 18*a*. Specifically, and with reference to FIGS. 5*a* and 5*b*, the upper members 58 are longer than the lower members 66 in the longitudinal direction, which is generally opposite of the arrangement employed in the first portion 18*a* of the boom extension section 18. This provides the end of the second portion 18*b* positioned adjacent the first portion 18*a* a similar triangular profile. Consequently, the two portions 18*a*, 18*b* when mated form the single boom extension section 18 that generally tapers in width in the longitudinal direction.

From reviewing the figures accompanying the foregoing discussion, it can be understood that the first portion 18*a* of the boom extension 18 is substantially shorter than the second portion 18*b*. Specifically, the first portion 18*a* at its greatest extent in the longitudinal direction D is no greater than (and preferably less than) about half as long as the second portion 18*b*. The advantages of this relative disparity in length among the portions 18*a*, 18*b* of the common first boom extension section 18 will be best understood upon reviewing the remainder of the description.

With reference to FIGS. 10*a*-10*c*, the first boom extension section 18 may optionally associate with a second boom extension ("tip" as shown, or "jib") section 72, such as by way of a pinned connection. This second section 72 is generally about the same length as the complete first section 18 (and thus is substantially longer than its first portion 18*a*), and tapers from a wider extent at one end (generally matching the narrower end of the first section 18) to a narrower extent at the other. If provided, this second section 72 may be stowed by folding it behind the boom extension section 18 when not in use (and preferably, the first section 18 may be erected while the disconnected second section 72 remains in the stowed position). The second section 72 may also include at least one sheave or pulley at the narrow end for receiving and guiding a hoist line in use. FIG. 10*a* also illustrates that the first portion 18*a* and the second portion 18*b*, which are discrete, are arranged in series in the stowed position.

In the active position, the first portion 18*a* of the first boom extension section 18 is secured to the head end 12*a* of the main boom assembly 12 by one of the pair of top adapter lugs 36. In particular, one of the pair of top adapter lugs 36 receives an upper arm 74 associated with the head end 12*a* of the main boom assembly 12. This arm 74 has a mating hole that corresponds to the vertically aligned holes 42 in the top adapter lug 36. The upper pin 44 is inserted through the mating hole and corresponding holes 42 in the top adapter lug 36 to secure the first portion 18*a* to the main boom assembly 12. The lower pins 54 may be inserted through matching apertures in a lower arm 84 associated with the boom head end 12*a* and the holes 42 of the bottom adapter lug 40.

Figure 11A:
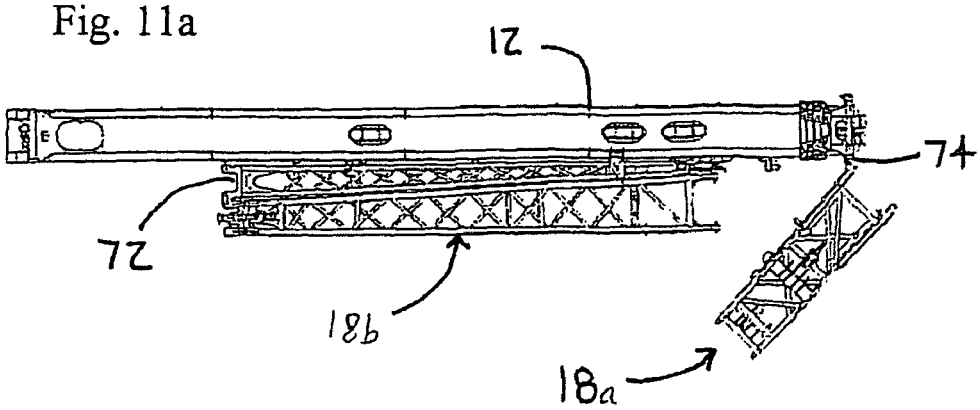
FIGS. 11*a*-11*c* are top views illustrating the progression of the short fly portion of the boom extension assembly erected into the operating position.
Figure 11B:
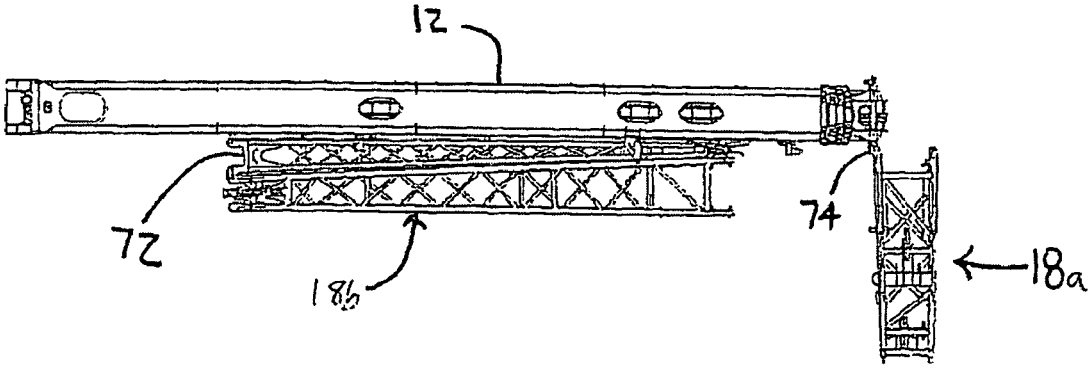
Figure 11C:
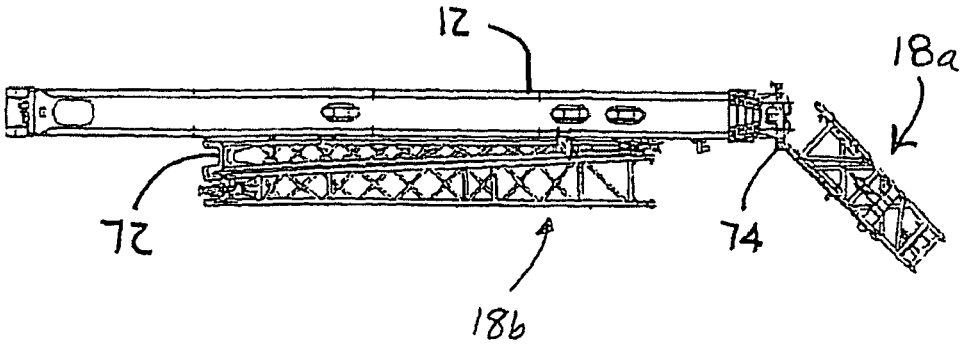

As should now be appreciated, an advantage of this arrangement is the ability to employ the first, shorter portion 18*a* of the boom section 18 without deploying any additional section(s) stored alongside the main boom assembly 12. Turning to FIGS. 11*a*-11*c*, an exemplary progression of the movement of the first portion 18*a* of the first boom extension section 18 from the stowed position into alignment with the main boom assembly 12 is described. As illustrated, the first portion 18*a* may be first connected along one side to the head end 12*a* of the main telescoping boom assembly 12, such as by using upper and lower pins 44, 54 to connect it to the corresponding end of the arm 74. The first portion 18*a* may then be disconnected or unpinned from the second portion 18*b* at the corresponding end, such as by removing pins 62, 64, 70. In this partially connected state, the first portion 18*a* may independently rotate into the operative position, and then pinned along the other side of the arms 74, 84, such as by using pins 44, 54, so as to be ready for independent use. Stowing the first portion 18*a* essentially involves reversing this procedure.

As should be appreciated, one of the advantages afforded by the independent use of the shorter first portion 18*a* of the first boom extension section 18 is the ability to simultaneously use multiple hoist ropes in close proximity. Specifically, with reference back to FIG. 1, a first hoist line $L_1$ may be reeved over the regular sheaves 12*b* associated with the head end 12*a* of the main boom assembly 12, while a second, independent line $L_2$ may be reeved through the sheaves 20, 22, 32 associated with the first portion 18*a* of the boom extension section. Advantageously, the relatively close proximity of these lines $L_1$, $L_2$ facilitates the simultaneous connection to a single object and, through independent manipulation (such as by using separate winches $W_1$, $W_2$) may be used to reorient it in an easy and efficient manner.

In the situation where a further extension of the boom is desired, the pinned connection between the first and second portions 18*a*, 18*b* in the stowed position may be maintained, and the single boom extension section 18 pivoted into the operative condition and fully connected to the head end 12*a*. This may also be done with the optional jib section 72 in place, to thereby provide a further extension of the telescoping boom assembly 12.

Although considered optional, the boom extension 18 may also be provided with the ability to be angularly offset relative to the head end 12*a* of the telescoping boom assembly 12, as is conventional. Actuators, such a hydraulic cylinders (not shown), may also be used to provide tufting capability to the boom extension section 18, as is also conventional.

In summary, it will be realized that the results and advantages of the present invention are to provide a boom extension section 18 that can be adapted to a shorter length, such as by using only first portion 18*a*, while also capable of use in a longer configuration and furthermore in combination with another interconnected boom extension section 72. Advantageously, the independent use of the shorter extension increases the versatility of the crane, such as by providing a shorter lift point without the need for bringing a separate adapter on site. When the short "fly" portion 18*a* of the boom extension section 18 is used alone, it is possible to use the crane in tighter places than might be possible with a longer extension section. Hoisting capability would also increase, including possibly by the use of two independent hoist lines maintained in relatively close proximity (which advantageously can be independently manipulated to turn objects in an efficient and effective manner).

The foregoing description of certain embodiments provides the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A mobile crane for intended use in lifting an object, comprising:

a boom assembly including at least two telescoping boom sections and a head end;

a boom extension assembly carried alongside the boom assembly, said boom extension assembly including a fly section having first and second portions arranged in series in a stowed position and adapted for being connected to each other, said first portion adapted for being connected to the head end of the boom assembly in an operative position while the second portion of the fly section remains in the stowed position;

wherein the first portion of the fly section is shorter in length than the second portion of the fly section.

2. The crane according to claim 1, wherein the boom extension assembly further includes a second section for connection to a first end of the second portion of the fly section, said first and second sections when connected together having a substantially continuous taper end of the first section for positioning adjacent to the head end of the boom to a second, narrower end of the second section for positioning generally opposite the head end of the boom.

3. The crane according to claim 2, wherein the first portion of the fly section is shorter in length than the second section.

4. The crane according to claim 1, wherein the first portion of the fly section includes at least one sheave for receiving a first hoist line.

5. The crane according to claim 1, wherein the boom head end includes a first sheave for receiving a first hoist line and the first portion of the fly section includes a second sheave for receiving a second hoist line.

6. The crane according to claim 1, wherein the first portion of the fly section includes a first end having upper and lower members of different lengths, and the second portion of the fly section includes a second end matching the first end of the first portion of the fly section.

7. The crane according to claim 1, wherein the fly section comprises a latticework body.

8. The crane according to claim 1, further including horizontally aligned apertures for receiving one or more pins for interconnecting the first and second portion of the fly section.

9. The crane of claim 1, wherein the first portion is pivotally connected to the head end of the boom.

10. A mobile crane for intended use in lifting an object using first and second hoist lines, comprising:

a boom assembly including at least two telescoping boom sections and a head end including a first sheave for receiving the first hoist line;

a boom extension assembly carried alongside of the boom assembly, said boom extension assembly including a fly section having first and second portions arranged in series in a stowed position and adapted for being connected to each other, said first portion adapted for being connected to the head end of the boom assembly in an active position while the second portion remains in a stowed position;

wherein said first portion of the fly section includes at least one second sheave for receiving the second hoist line.

11. The crane according to claim 10, wherein the fly section includes a plurality of second sheaves.

12. A mobile crane for intended use in lifting an object, comprising:

a boom assembly including at least two telescoping boom sections and a head end;

a boom extension assembly carried on the lateral side of the boom assembly, said boom extension assembly comprising a fly section, said fly section comprising a first portion adapted for being connected to the head end of the boom assembly in an active position while a second portion remains in a stowed position;

wherein the first portion of the fly section for positioning generally opposite the head end of the boom in the active position includes a first end having upper and lower members of different lengths, and is adapted for connecting to a second, matching end of the second portion of the fly section.

13. The crane according to claim 12, wherein the first portion of the fly section includes at least one sheave for receiving at least one hoist line.

14. The crane according to claim 13, wherein the head end of the boom includes a first sheave for receiving a first hoist line and the first portion of the fly section includes a second sheave for receiving a second hoist line.

15. The crane according to claim 12, wherein an upper member of the first portion of the fly section is longer than a lower member thereof.

16. In a mobile crane including a boom extension assembly carried alongside a telescoping boom assembly having a head end, said boom extension assembly having a stowed position and movable to an active position for extending the reach of the telescoping boom assembly, the improvement comprising the boom extension assembly including at least three releasably attached, non-telescoping sections, said releasably attached sections including a first section having a first end for connecting to the head end of the telescoping boom assembly, a second end generally opposite the first end for connecting to a third end of a second section, said second section having a fourth end generally opposite the third end for connecting to a fifth end of a third section of the boom extension assembly.

17. The improvement of claim 16, wherein each releasably attached section comprises a latticework structure.

18. The improvement of claim 16, wherein the releasably attached sections together taper in a vertical direction from the first end of the first section to a sixth end of the third section.

19. A method of selectively extending a telescoping boom assembly of a mobile crane, comprising:

providing a boom extension assembly alongside the telescoping boom assembly, said boom extension assembly comprising a fly section, said fly section including a first discrete portion shorter in length than a second discrete portion;

positioning the first portion of the fly section at a head end of the telescoping boom assembly in an operative position for extending the reach of the boom assembly while the second portion of the fly section remains in a non-operative position.

20. The method of claim 19, further including the steps of providing the connected first portion of the fly section with a first hoist line and providing the head end of the boom assembly with a second hoist line.

21. The method of claim 19, further including the steps of:

disconnecting the first portion of the fly section from the head end of the telescoping boom assembly; and connecting the first portion of the fly section to the second portion of the fly section.

22. The method of claim 21, further including the step of reconnecting the fly section including the first and second portions to the head end of the telescoping boom assembly.

23. The method of claim 19, further including the step of connecting a tip section to the fly section.

24. A mobile crane for intended use in lifting an object, comprising:

a boom assembly including at least two telescoping boom sections and a head end;

a boom extension carried alongside the boom assembly for extending the reach thereof in an operative condition, said boom extension including a fly section having first and second discrete portions, said first portion including a first end adapted for being connected to the head end of the boom assembly in an operative position while the second portion of the fly section adapted for being connected to the first portion remains alongside the boom assembly, and said first portion having a second end adapted for connecting to a third end of the second portion of the fly section;

wherein the first portion of the fly section is shorter in length than the second portion of the fly section.

* * * * *

UNITED STATES PATENT AND TRADEMARK OFFICE

CERTIFICATE OF CORRECTION

PATENT NO. : 7,878,346 B1
APPLICATION NO. : 12/197529
DATED : February 1, 2011
INVENTOR(S) : Watts et al.

It is certified that error appears in the above-identified patent and that said Letters Patent is hereby corrected as shown below:

Claim 2, column 8, line 20, after "taper" insert -- from a first, larger --.

Signed and Sealed this
Nineteenth Day of April, 2011

David J. Kappos

David J. Kappos
*Director of the United States Patent and Trademark Office*